US008439486B2

(12) United States Patent
Andrews et al.

(10) Patent No.: US 8,439,486 B2
(45) Date of Patent: May 14, 2013

(54) METHOD FOR ASSEMBLING A PRINTHEAD HAVING AN INKJET EJECTOR WITH A POLYMER APERTURE PLATE ATTACHED TO AN OUTLET PLATE

(75) Inventors: John R. Andrews, Fairport, NY (US); David A. Tence, Tualatin, OR (US); Terrance Lee Stephens, Molalla, OR (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/491,959

(22) Filed: Jun. 8, 2012

(65) Prior Publication Data

US 2012/0247659 A1 Oct. 4, 2012

Related U.S. Application Data

(62) Division of application No. 12/640,205, filed on Dec. 17, 2009, now Pat. No. 8,240,818.

(51) Int. Cl.
*B41J 2/045* (2006.01)

(52) U.S. Cl.
USPC ..... 347/71

(58) Field of Classification Search ..... 347/68–72; 400/124.14, 124.16; 310/311, 324, 327, 310/365
See application file for complete search history.

(56) References Cited

U.S. PATENT DOCUMENTS

| | | | | |
|---|---|---|---|---|
| 6,443,557 | B1 | 9/2002 | Pan et al. | |
| 6,488,367 | B1 * | 12/2002 | Debesis et al. | 347/70 |
| 7,594,714 | B2 | 9/2009 | Katayama | |
| 7,766,463 | B2 * | 8/2010 | Stephens et al. | 347/71 |
| 8,006,356 | B2 * | 8/2011 | Andrews et al. | 29/25.35 |
| 2008/0239022 | A1 | 10/2008 | Andrews et al. | |

* cited by examiner

*Primary Examiner* — Kristal Feggins
(74) *Attorney, Agent, or Firm* — Maginot, Moore & Beck, LLP

(57) ABSTRACT

A method of assembly produces a printhead having a polymer aperture plate and outlet plate that are at least 25 mm in length. The method includes bonding the polymer aperture plate to the outlet plate, which is configured with outlets. A laser is aligned with the outlets in the outlet plate to ablate apertures in the polymer aperture plate and the outlet plate is bonded to an inkjet stack to couple the outlets in the outlet plate to pressure chambers in a body plate in the inkjet stack.

6 Claims, 3 Drawing Sheets

METHOD FOR ASSEMBLING A PRINTHEAD HAVING AN INKJET EJECTOR WITH A POLYMER APERTURE PLATE ATTACHED TO AN OUTLET PLATE

CLAIM OF PRIORITY

This application is a divisional application of and claims priority to application Ser. No. 12/640,205, which is entitled "An Inkjet Ejector Having A Polymer Aperture Plate Attached To An Outlet Plate And Method For Assembling An Inkjet Ejector," which was filed on Dec. 17, 2009, and which issued as U.S. Pat. No. 8,240,818 on Aug. 14, 2012.

TECHNICAL FIELD

This disclosure relates generally to inkjet ejectors that eject ink from a print head onto an image receiving surface and, more particularly, to inkjet ejectors in print heads comprised of multiple layers.

BACKGROUND

Drop on demand inkjet technology has been employed in commercial products such as printers, plotters, and facsimile machines. Generally, an inkjet image is formed by the selective activation of inkjets within a print head to eject ink onto an ink receiving member. For example, an ink receiving member rotates opposite a print head assembly as the inkjets in the print head are selectively activated. The ink receiving member may be an intermediate image member, such as an image drum or belt, or a print medium, such as paper. An image formed on an intermediate image member is subsequently transferred to a print medium, such as a sheet of paper.

FIGS. 3A and 3B illustrate one example of a single inkjet ejector 10 that is suitable for use in an inkjet array of a print head. The inkjet ejector 10 has a body 48 that is coupled to an ink manifold 12 through which ink is delivered to multiple inkjet bodies. The body also includes an ink drop-forming orifice or nozzle 14 through which ink is ejected. In general, the inkjet print head includes an array of closely spaced inkjet ejectors 10 that eject drops of ink onto an image receiving member (not shown), such as a sheet of paper or an intermediate member.

Ink flows from the manifold to nozzle in a continuous path. Ink leaves the manifold 12 and travels through a port 16, an inlet 18, and a pressure chamber opening 20 into the body 22, which is sometimes called an ink pressure chamber. Ink pressure chamber 22 is bounded on one side by a flexible diaphragm 30. A piezoelectric transducer 32 is secured to diaphragm 30 by any suitable technique and overlays ink pressure chamber 22. Metal film layers 34, to which an electronic transducer driver 36 can be electrically connected, can be positioned on either side of piezoelectric transducer 32.

Ejection of an ink droplet is commenced with a firing signal. The firing signal is applied across metal film layers 34 to excite the piezoelectric transducer 32, which causes the transducer to bend. Because the transducer is rigidly secured to the diaphragm 30, the diaphragm 30 deforms to urge ink from the ink pressure chamber 22 through the outlet port 24, outlet channel 28, and nozzle 14. The expelled ink forms a drop of ink that lands onto an image receiving member. Refill of ink pressure chamber 22 following the ejection of an ink drop is augmented by reverse bending of piezoelectric transducer 32 and the concomitant movement of diaphragm 30 that draws ink from manifold 12 into pressure chamber 22.

To facilitate manufacture of an inkjet array print head, inkjet ejector 10 can be formed of multiple laminated plates or sheets. These sheets are configured with a plurality of pressure chambers, outlets, and apertures and then stacked in a superimposed relationship. Referring once again to FIGS. 3A and 3B for construction of a single inkjet ejector, these sheets or plates include a diaphragm plate 40, an inkjet body plate 42, an inlet plate 46, an outlet plate 54, and an aperture plate 56. The piezoelectric-transducer 32 is bonded to diaphragm 30, which is a region of the diaphragm plate 40 that overlies ink pressure chamber 22.

In some known thermal inkjet print heads, the aperture plate may be a polymer layer in which apertures are formed using laser ablation. The advantages of using a polymer layer include low cost and the ability to taper or otherwise shape the apertures. Thermal inkjet print heads, however, are typically dimensioned with lengths less than 25 mm. Print heads using piezoelectric transducers, on the other hand, may have lengths from about 25 mm to over 300 mm in length. Additionally, the number of aperture rows in such print heads can significantly exceed two. The flexibility and dimensional variation in polymer aperture plates can vary substantially from differing humidity and temperature fluctuations. These variations make consistency in aperture placement and formation difficult. Moreover, in systems having multiple piezoelectric print heads, these variations make print head alignment a challenge to both achieve and maintain. Inkjet efficiency may also be affected by a large outlet supplying ink to an aperture with energy sufficient to displace or otherwise disturb the aperture plate. Thus, significant issues need to be addressed before polymer aperture plates can be incorporated in piezoelectric print heads.

SUMMARY

A method for forming a polymer aperture plate has been developed that enables the polymer aperture plate to be attached in alignment with outlets in an outlet plate more precisely. The method includes bonding a polymer aperture plate to an outlet plate configured with outlets, and aligning a laser with the outlets in the outlet plate to ablate apertures in the polymer aperture plate that are aligned with the outlets.

The method produces piezoelectric print heads that can take advantage of the economy of polymer plates. The piezoelectric head includes a body layer in which a plurality of pressure chambers is configured, a flexible diaphragm plate proximate the body layer, a layer of piezoelectric transducers, each piezoelectric transducer having a bottom surface attached to the diaphragm plate, a metal outlet plate in which outlets are configured, the metal outlet plate having a length of at least 25 mm, and a polymer aperture plate having apertures aligned with the outlets in the metal outlet plate and the polymer aperture plate having a length of at least 25 mm.

BRIEF DESCRIPTION OF THE DRAWINGS

The foregoing aspects and other features of forming apertures in a polymer layer precisely aligned with channels in an outlet plate bonded to the polymer layer are explained in the following description, taken in connection with the accompanying drawings.

DETAILED DESCRIPTION

Figure 1A:
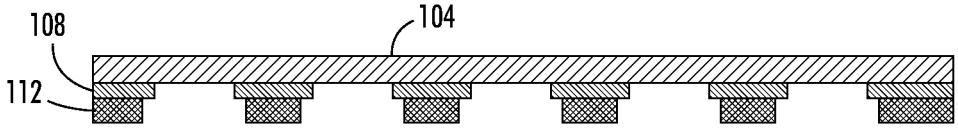
FIG. 1A is a diagram of a polymer layer bonded to an outlet plate using an adhesive.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that performs a print outputting function for any purpose, such as a digital copier, bookmaking machine, facsimile machine, a multi-function machine, etc. Devices of this type can also be used in bioassays, masking for lithography, printing electronic components such as printed organic electronics, and for making 3D models among other applications. The word "ink" can refer to wax-based inks known in the art but can refer also to any fluid that can be driven from the jets including water-based solutions, solvents and solvent based solutions, and UV curable polymers. The word "polymer" encompasses any one of a broad range of carbon-based compounds formed from long-chain molecules including thermoset polyimides, thermoplastics, resins, polycarbonates, and related compounds known to the art. The word "metal" may encompass either single metallic elements including, but not limited to, copper, aluminum, or titanium, or metallic alloys including, but not limited to, stainless steel or aluminum-manganese alloys. A "transducer" as used herein is a component that reacts to an electrical signal by generating a moving force that acts on an adjacent surface or substance. The moving force may push against or retract the adjacent surface or substance.

FIG. 1A is a diagram of a polymer layer bonded to an outlet plate using an adhesive. The polymer layer 104 may be formed from a polyimide material or other polymers including polyetherether ketone, polysulfone, polyester, polyethersulfone, polyimideamide, polyamide, polyethylenenaphthalene, etc. The polymer layer can be a self-adhesive thermoplastic or have a thin layer of adhesive deposited on the side of the polymer layer that is placed in contact with the outlet plate. In the embodiment of FIG. 1A, there is an adhesive layer 108 placed between the polymer layer and the outlet plate. Suitable adhesive layers include double sided adhesive tapes having thermoset or thermoplastic adhesive layers on opposite sides of a thermoset or thermoplastic polymer core. Alternatively, the adhesive layer can be a thermoplastic or thermoset adhesive. In yet further alternatives the adhesive could be a dispensed or transfer film of liquid adhesive. The adhesive layer may have a thickness in a range of about 1 to about 25 microns and, in one embodiment, the adhesive layer has a thickness of about 2 to about 5 microns. The outlet plate 112 has a plurality of outlet ports 114 etched through the plate. Pressure and heat are applied to the polymer layer, adhesive, and outlet plate in order to secure the bond between the polymer layer and metal outlet plate. In one embodiment having a thin adhesive layer, a pressure of 290 psi is applied at 350 degrees C. for 30 minutes to secure the bond.

Figure 1B:
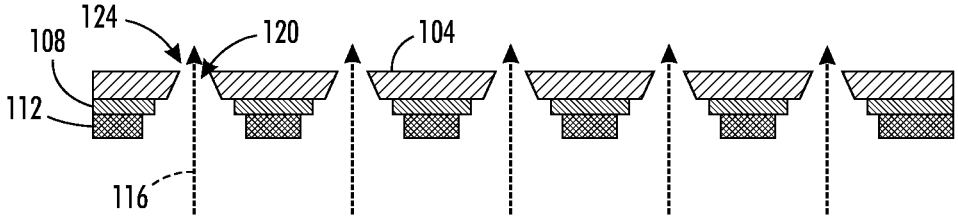
FIG. 1B is a diagram of the adhesively bound polymer layer and outlet plate being exposed to a beam of laser light.

FIG. 1B depicts a laser beam 116 ablating apertures 120 through the portions of the polymer layer that are not covered by the outlet plate. In this process, the outlet plate provides alignment features to locate the laser drilled apertures with reference to the outlet plate. In some cases, the aperture plate can have a thin adhesive layer attached directly to the aperture plate film. The laser can then drill through an aperture plate composed of multiple layers that may include an adhesive on the outlet plate side and an anti-wetting coating on the exterior side. In yet another embodiment, the adhesive layer can be a separate film or double-sided tape. The separate adhesive layer can be patterned through a variety of means including die cutting or laser cutting to include outlet holes that coincide with the outlet holes in the outlet plate. In some embodiments, the patterned adhesive layer alone may serve as the outlet plate.

Figure 1C:
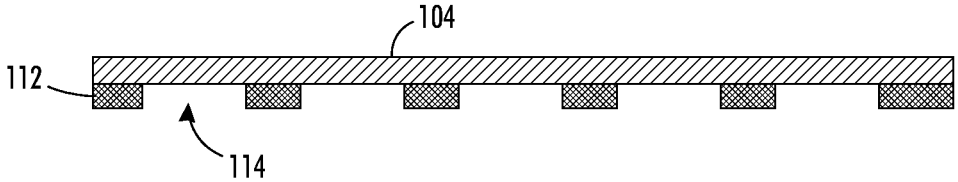
FIG. 1C is a diagram of a polymer layer bonded directly to an outlet plate.
Figure 1D:
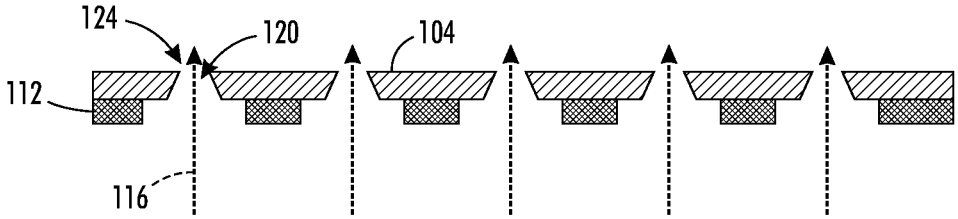
FIG. 1D is a diagram of the directly bound polymer layer and outlet plate being exposed to a beam of laser light.

FIG. 1C is a diagram of an alternative embodiment polymer layer directly bonded to an outlet plate. The polymer layer 104 may be formed from a polyimide material or one of the other materials noted above. In the embodiment of FIG. 1C, the polymer layer is placed in direct contact with the outlet plate. The outlet plate 112 has a plurality of outlet ports 114 etched through the plate. Pressure and heat are applied to the polymer layer causing it to bond to the outlet plate. In one embodiment, a pressure of 290 psi is applied at 350 degrees C. for 30 minutes to bond the polymer layer and outlet plate. FIG. 1D depicts a laser beam 116 ablating apertures 120 through the portions of the polymer layer that are not covered by the outlet plate.

In each embodiment shown in FIGS. 1A, 1B, 1C, and 1D, the improved aperture forming process enables print heads to be formed with polymer plates that are at least 25 mm in length, with matching outlet plates that are also at least 25 mm in length. The outlet plate may be formed from a metal or alloy in sizes of at least 25 mm while being resilient enough to operate in an inkjet stack, with stainless steel being one appropriate example. Alternatively, the outlet plate may be a rigid or semi-rigid polymer layer, such as a patterned polymer layer or double-sided tape. "Rigid" as used in this document refers to a plate or layer exhibiting sufficient stiffness that bowing or other dimensional displacement that adversely impacts the jetting of ink droplets from the apertures in the polymer layer does not occur. As used in this document, the term "rigid polymer layer" refers to both rigid and semi-rigid polymer layers. In each embodiment, the ablation process may use an excimer laser having a power level and frequency appropriate for ablating the polymer layer. In one embodiment, an excimer laser is operated with a 248 nm or 308 nm wavelength and a laser fluence in a range of about 250 $mJ/cm^2$ to about 800 $mJ/cm^2$. Alternatively, ablation may be achieved using a solid state laser operating at 266 nm or 355 nm in a range of about 10 KHz to about 250 KHz at a power level in a range of about 0.5 W to about 25 W.

Two key advantages are enabled by drilling the apertures of the array after the polymer is bonded to the rigid outlet plate. For one, all of the apertures can be within 5 μm of the correct position within the array relative to one another over long linear distances of about 25 mm to greater than 300 mm. The ability to maintain the straightness over the long axis of the array is a particularly significant advantage over drilling the apertures in the film prior to bonding. Another advantage is that the array can be located accurately with respect to alignment targets on the outlet plate. The alignment targets may be features for mechanical alignment to the head body or optical alignment targets for active optomechanical alignment.

Figure 2:
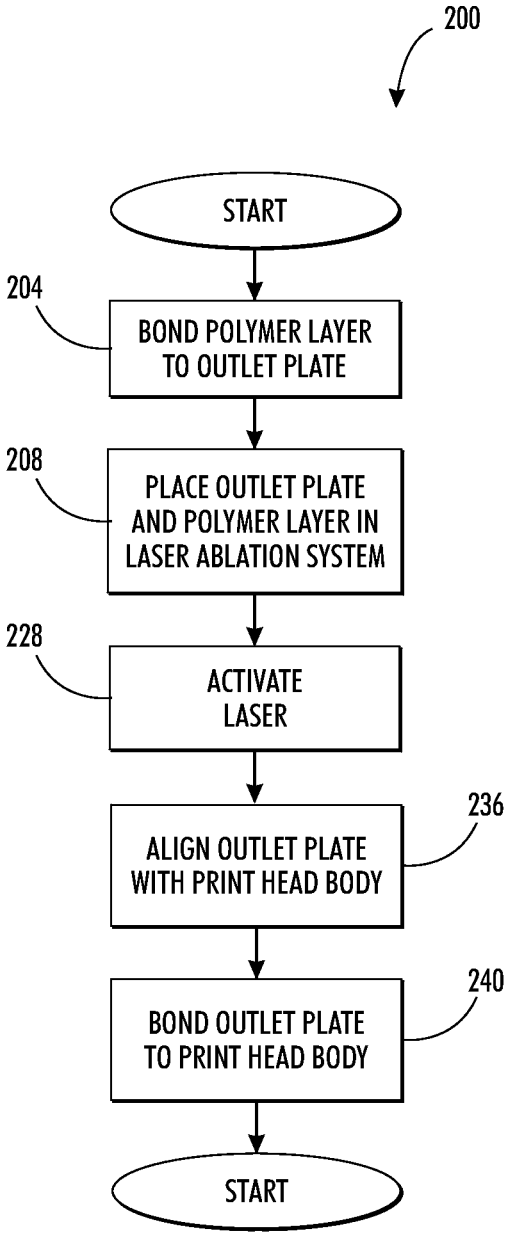
FIG. 2 is a block diagram of a process for forming a polymer aperture plate from a polymer layer bound to an outlet plate, and assembling a print head with the polymer aperture plate.
Figure 3A:
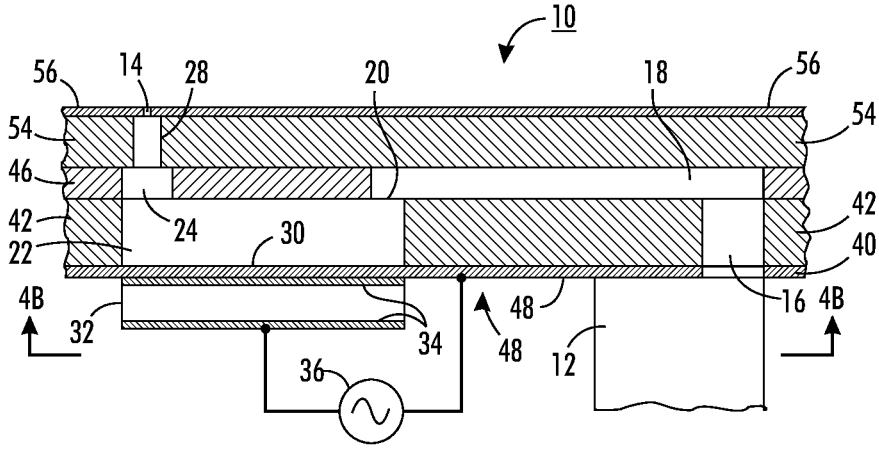
FIG. 3A PRIOR ART
FIG. 3A is a schematic side-cross-sectional view of a prior art embodiment of an inkjet.
Figure 3B:
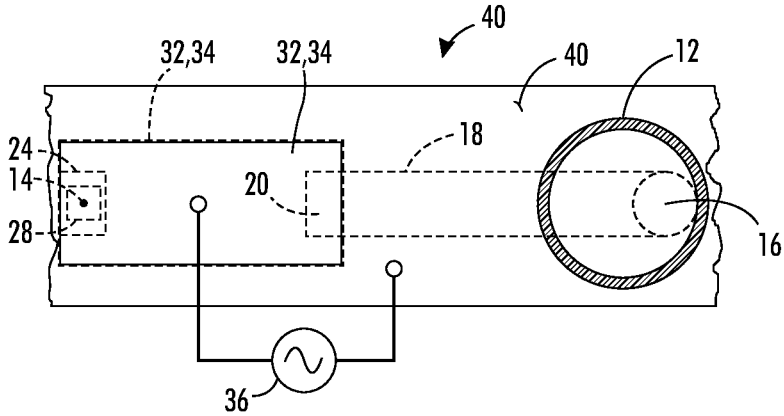
FIG. 3B PRIOR ART
FIG. 3B is a schematic view of the prior art embodiment of the inkjet of FIG. 3A.

FIG. 2 is a block diagram of a process 200 for forming a polymer aperture plate from a polymer layer bound to an outlet plate, and assembling a print head with the polymer aperture plate. First, a polymer layer is bound to an outlet plate using the process described above (block 204). The outlet plate is then placed in a laser ablation system with one possible type of laser used in such a system being an excimer laser (block 208). Because the outlet plate acts as a mask to allow the laser light through the outlet ports selectively to ablate apertures in the polymer layer, the outlet plate must be located between the laser and the polymer layer. After the metal outlet plate and polymer layer are placed within the laser ablation system, the laser is activated (block 212) to form the apertures in the aperture plate, the polymer aperture plate and outlet plate are removed from the laser ablation system for assembly with the remainder of an ink jet stack. First, the outlet plate is aligned with the inkjet ejector stack body, and in particular, aligned to enable ink to flow from the pressure chambers through the outlet ports to the apertures in the polymer aperture plate (block 236). Next, the side of the outlet plate opposite the polymer aperture plate is bonded to the inkjet stack (block 240). A thermoset or thermoplastic adhesive may be placed between the outlet plate and the inkjet stack with pressure applied to bond them together. In other embodiments, the outlet plate is placed in direct contact with the inkjet stack, and applied pressure causes the inkjet body layer to bond to the outlet plate.

In operation, aperture plates are prepared from polymer material bonded to an outlet plate configured with outlets. The aperture plates are laser ablated from the outlet plate side to form apertures, which are precisely aligned with the outlets. The outlet plate may be attached to a partially constructed inkjet stack to provide outlets and apertures for pressure chambers in the inkjet stack. This bonding rigidly positions the apertures and outlets with the pressure chambers to form inkjet ejectors that are aligned more precisely even though the more flexible polymer material was used.

It will be appreciated that various of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A method for assembling a print head comprising:

bonding a polymer aperture plate to an outlet plate configured with outlets, the polymer aperture plate and the outlet plate having a length of at least 25 mm;

aligning a laser with the outlets in the outlet plate to ablate apertures in the polymer aperture plate that are aligned with the outlets; and bonding the outlet plate to an inkjet stack to couple the outlets in the outlet plate to pressure chambers in a body plate in the inkjet stack.

2. The method of claim 1 wherein the polymer aperture plate is a polyimide aperture plate.

3. The method of claim 1 wherein the laser is an excimer laser, a solid state laser, or a fiber laser.

4. The method of claim 1, the bonding of the polymer aperture plate to the outlet plate further comprising:

applying a thermoset adhesive or a thermoplastic adhesive to the polymer aperture plate; and pressing the applied adhesive on the polymer aperture plate against the outlet plate.

5. The method of claim 1, the bonding of the outlet plate to the inkjet stack further comprising:

applying a thermoset adhesive or thermoplastic adhesive to the outlet plate; and pressing the applied adhesive on the outlet plate against the body layer.

6. The method of claim 1 wherein the outlet plate is a stainless steel outlet plate or a rigid polymer outlet plate.

* * * * *